US007484803B2

(12) United States Patent
Dozsa-Farkas

(10) Patent No.: US 7,484,803 B2
(45) Date of Patent: Feb. 3, 2009

(54) CHAIR, ESPECIALLY AND OFFICE OR WORK CHAIR

(75) Inventor: Andras Dozsa-Farkas, Munich (DE)

(73) Assignee: OMP S.r.l, Castello Di Godego (IT)

( * ) Notice: Subject to any disclaimer, the term of this patent is extended or adjusted under 35 U.S.C. 154(b) by 170 days.

(21) Appl. No.: 10/545,850

(22) PCT Filed: Feb. 13, 2004

(86) PCT No.: PCT/EP2004/001363

§ 371 (c)(1),
(2), (4) Date: May 18, 2006

(87) PCT Pub. No.: WO2004/073457

PCT Pub. Date: Sep. 2, 2004

(65) Prior Publication Data

US 2006/0244294 A1 Nov. 2, 2006

(30) Foreign Application Priority Data

Feb. 18, 2003 (DE) ..... 103 06 851

(51) Int. Cl.
*A47C 1/032* (2006.01)

(52) U.S. Cl. ..... 297/320; 297/300.2; 297/300.3; 297/318; 297/323

(58) Field of Classification Search ..... 297/300.2, 297/300.3, 317, 318, 320, 322, 323
See application file for complete search history.

(56) References Cited

U.S. PATENT DOCUMENTS 4,840,426 A 6/1989 Vogtherr et al.
4,861,106 A * 8/1989 Sondergeld ..... 297/316
4,877,291 A * 10/1989 Taylor ..... 297/300.3
4,984,846 A * 1/1991 Ekornes ..... 297/317
5,005,905 A * 4/1991 Sondergedl ..... 297/320

(Continued)

FOREIGN PATENT DOCUMENTS

DE 33 136 77 10/1984

(Continued)

*Primary Examiner*—Peter R. Brown
(74) *Attorney, Agent, or Firm*—Henry M. Feiereisen; Ursula B. Day

(57) ABSTRACT

The invention relates to a chair, especially an office or work chair or similar, whereon a back-rest part (15) can be placed in an inclined position from an initial or rest position via a first axis of rotation (12). A seating part (14) performs a longitudinal displacement around a second axis of rotation (20) and an inclined displacement around a third axis of rotation (11) in a synchronous manner with respect to the inclined movement of the back-rest part (15). A return device (13) is provided for returning the back-rest part (15) and/or seating part (14) to the initial position or rest position. The office chair (1) comprises a carrier frame (5) which disposed centrically on the leg frame (2) and which supports in a stationary manner the first axis of rotation (12) on the centre of the leg frame, said axis of rotation remaining at a constant, predetermined distance above the seating part (14) in the rest position and in all inclined positions of the back-rest part (15). Said first axis of rotation (12) is connected in a secure manner to the back-rest part (15) by means of a pivoting lever (16).

17 Claims, 4 Drawing Sheets

U.S. PATENT DOCUMENTS

Figure 1:
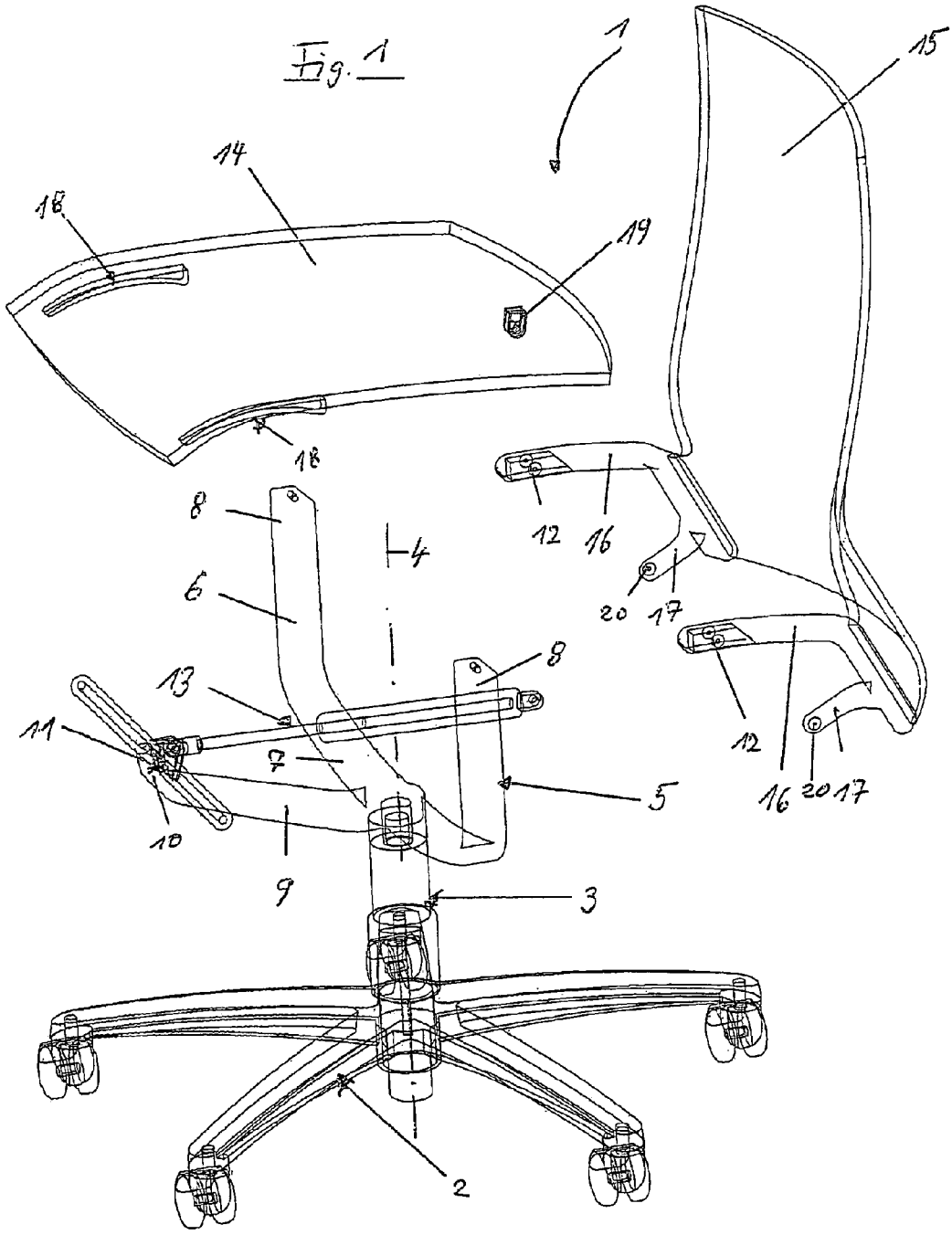

| | | | | |
|---|---|---|---|---|
| RE34,354 | E | 8/1993 | Sondergeld | |
| 5,308,145 | A * | 5/1994 | Koepke et al. | 297/342 |
| 6,685,267 | B1 * | 2/2004 | Johnson et al. | 297/300.1 |
| 7,234,775 | B2 * | 6/2007 | Serber | 297/301.1 |
| 2004/0075321 | A1 | 4/2004 | Sangiorgio | |

FOREIGN PATENT DOCUMENTS

| | | | |
|---|---|---|---|
| DE | 199 27 691 | A1 | 12/2000 |
| EP | 0 296 578 | A1 | 12/1988 |
| EP | 0 309 804 | A2 | 4/1989 |
| EP | 1 410 738 | | 4/2004 |

* cited by examiner 1
15
14
18
19
18
8
4
12
16
6
20
17
8
13
11
7
12
5
16
20
17
10
9
3
2

CHAIR, ESPECIALLY AND OFFICE OR WORK CHAIR

PRIOR ART

The present invention relates to a chair, in particular a desk or office chair, and equally relates to recliners, easy chairs, upholstered furniture, or the like.

DE 199 27 691 A1 has disclosed a chair, in particular a desk chair, which has a seat support that functions as a support frame. This seat support is attached to a back rest part, which is able to pivot around a first rotation axis and can pivot around this first rotation axis, from a normal position into a number of reclined positions. A seat part can be tilted around a second rotation axis synchronously with the back rest, can be slid longitudinally, and can be tilted around a third rotation axis in relation to the support frame in a restrictively guided fashion. In this field of use in chairs such as desk chairs or the like, so-called return devices are provided, which return the back rest part and/or the seat part to their respective normal positions.

All of the previously known designs share the aim of avoiding a rearward tipping movement of the chair while permitting the person sitting in the chair to execute reclining movements, even large reclining movements of the back rest part with an inclination of up to 40°, for example, in relation to the starting or normal position of the back rest part, without giving the person the impression that the chair might suddenly tip over or giving the chair an unstable and unpleasant feel. In the chair according to DE 199 27 791 A1, the design was conceived so that in the normal position of the back rest part, the first rotation axis is positioned at approximately the same height as or higher than the second rotation axis. In addition, the first rotation axis should be higher than the lower edge of the seat part. But as is clear from this application from the prior art, with this chair known from DE 199 27 691 A1, in the process of the reclining movement of the back rest part in relation to the support frame or the seat support, the first rotation axis moves upward beyond the seat part. In this known chair, the reclining movement of the back rest part from the starting position to the normal position is limited to a reclining angle value of at most 40°.

By contrast, the aim of the present invention is to create a chair, in particular a desk chair, office chair, or the like in which the reclining range of the back rest part can be increased to at least 45° in a structurally simple manner and which gives a chair of this kind an improved stability in all positions of the back rest part and/or seat part, without giving the person sitting in it any impression that it is unstable or might tip over.

To this end, the present invention has created a chair, in particular a desk or office chair, having a back rest part, which is supported so that it can rotate around a first rotation axis in relation to a support frame and can be tilted from its normal position into a number of reclined positions, having a seat part, which is attached to the seat back part so that it can be rotated around a second rotation axis, can be synchronously slid longitudinally in relation to the back rest part, and can be rotated in a restriction-guided fashion around a third rotation axis in relation to the support frame, and having a return device for returning the back rest part and/or the seat part to their respective normal positions or starting positions. This chair is distinguished by the fact that (in the normal position and in all inclined positions of the back rest part and/or the seat part), the first rotation axis on the support frame is always situated in a stationary fashion, centered in relation to the pedestal, above and spaced apart from the seat part by a predetermined constant distance, preferably in a range from 50 to 200 mm, and by the fact that a pivoting lever that can move around the first stationary rotation axis is connected at least to the back rest part in its lower region.

With the design of the chair according to the present invention, the rotation axis for the reclining movement of the back rest part is always stationary and spaced a predetermined distance apart from the surface of the seat part in such a way that this first rotation axis is centered in relation to the pedestal. As a result, when a reclining movement of the back rest part is executed in the chair according to the present invention, possibly synchronously with a longitudinal movement and/or tilting movement of the seat part, no tipping moments are generated because the first rotation axis is designed to be stationary and is and remains constantly fixed in the axial direction of the chair, in the normal position and in all reclined positions. Furthermore, this design according to the present invention also results in the fact that the inclination angle for the back rest part can be significantly increased up to 45° and more, without resulting in unstable conditions. This allows the chair to be brought into a reclined position of the back rest part that is very relaxing for the person sitting in the chair and thanks to the stationary positioning of the first rotation axis in a centered position in relation to the pedestal, no tipping moments occur during the reclining motion of the back rest part of the chair that could make the person sitting in the chair feel uncomfortable or unsafe. The design of the chair according to the present invention is thus able to significantly improve comfort and in particular, permits a greater longitudinal movement path for the seat part, without sacrificing any stability.

Preferably the design according to the present invention is conceived in such a way that the second rotation axis for the rotatable, synchronous connection of the back rest part and the seat part is situated at the height of the seat part. In a structurally simple way, this achieves a synchronous tandem movement when executing a rotating movement around the second rotation axis during the reclining movement of the back rest part and the longitudinal movement of the seat part. A correspondingly suitable reclining action, combined with the longitudinal sliding movement of the seat part, is then executed by means of a restricted guidance around the third rotation axis, which is spaced apart from the second rotation axis and likewise designed to be stationary in relation to the support frame. This third rotation axis particularly permits the seat part, during its longitudinal movement, to be tilted slightly upward, for example, synchronously with the reclining movement of the back rest part in order to effectively prevent a pinching in the knee or lower leg region of the person sitting in the seat during the move into the reclined position. With the design of the chair according to the present invention, the bodily center of gravity of a person sitting in the chair is and remains essentially always centered in relation to the pedestal, regardless of the reclined position of the back rest part, thanks to the centering of the stationary first rotation axis in relation to the pedestal. This also makes the person sitting in the chair feel comfortable when executing a reclining movement of the back rest part.

Preferably, the back rest part has at least one connecting element attached to it, which causes the seat part to move along with the execution of the reclining movement of the back rest part, in the longitudinal direction by executing a rotating movement around the second rotation axis in relation to the support frame. This at least one connecting element synchronously causes the seat part to move along with the reclining movement of the back rest part in a structurally simple way and the seat part can thus be moved synchronously with the reclining movement of the back rest part by means of a restricted guidance, with a large degree of freedom with regard to the design of the movements of the seat part in the longitudinal and/or reclining direction.

Preferably, the third rotation axis for the execution of a tilting movement of the seat part is situated in a stationary fashion on the support frame and cooperates by means of a sliding or restrictive guide with the underside of the seat part. This makes it possible to effectively reduce the risk of injury and allows the third rotation axis and the associated sliding guide to be suitably positioned on the support frame of the chair.

Preferably, the design of the chair according to the present invention is conceived so that a connecting element is attached to both sides of the back rest part and/or a sliding guide is provided on both sides of the seat part in order to cooperate with the third rotation axis on the support frame. This provides a symmetrical placement of the connecting elements and sliding guides for the restrictively guided movement of the seat part so that the seat part is always supported in a uniform, safely tilting manner as it is restrictively guided in connection with the reclining movement of the back rest part.

Preferably, the return device is positioned between the support frame and the seat part, in particular centrally underneath the seat part, which achieves a space-saving placement of the return device. The return device is preferably constituted by a spring device. Naturally, other intrinsically known return devices can also be used in this region if need be.

In the chair according to the present invention, the support frame is in particular constituted by an essentially U-shaped bracket whose horizontal leg extends under the seat part and whose leg ends protrude upward beyond the seat part and support the first rotation axis for the reclining movement of the back rest part. With this design, the support frame extends under the seat part and the lateral leg ends protrude vertically like pedestals a predetermined height above the seat part in order to position the first rotation axis at the desired, predetermined stationary position above and spaced apart from the seat part. This design is also able to lend the support frame a sufficient degree of inherent stability with the smallest possible material cross sections. Preferably, the horizontal leg is in fact connected in the middle to a pedestal, which can be embodied in the form of a central pedestal, a tubular frame, or the like. The horizontal leg here serves to reliably position the support frame so that it is centered over the pedestal in order to prevent tipping moments in a structurally simple way in a chair of this kind with a reclining back rest part.

With the chair according to the present invention, the horizontal leg of the support frame is preferably provided with a supporting arm extending essentially perpendicular to it for the third rotation axis that cooperates with the seat part in the execution of a reclining movement. This supporting arm thus allows the third rotation axis to be positioned on the support frame in a stationary, cantilevered fashion and therefore also to be associated with the first rotation axis in a stationary fashion, at a suitable location spaced apart from the central axis of the support frame and the pedestal. The length of the supporting arm for the third rotation axis can be suitably selected in accordance with the length of the seat part and its longitudinal movement range. In connection with the restrictive sliding guide of the seat part situated on both sides, symmetrical to the longitudinal central axis, this achieves a reliable, stable support of the seat part in all movement positions of the seat part. Preferably, the third rotation axis for the tilting movement of the seat part is situated at the free end of the supporting arm and extends parallel to the seat part. This provides a support with a stable rest for the center of gravity on the underside of the seat part.

Preferably, the return device is attached to the free end of the supporting arm for the third rotation axis at one end and to a suitable location on the seat part at the other, for example close to the back rest part. This design allows the return device to transmit the restoring forces to the seat part and/or the back rest part with as little loss of force as possible.

In order to minimize the size of the components of the chair according to the present invention, the connecting element or elements on the back rest part and seat part constitutes or constitute a unit with the pivoting lever for the back rest part or is/are integrally joined to it, and the connecting element or elements of the back rest part and seat part are preferably connected to the pivoting lever at its end closest to the back rest part. Consequently, with a corresponding design and placement of the connecting element or elements of the back rest part and seat part with the pivoting lever for the back rest part, with a corresponding coordination, the sequence of motions can be set into a fixed spatial association with a view to synchronizing the reclining movement of the back rest part or the longitudinal movement of the seat part.

In particular, the pivoting lever is embodied as curved in an L-shape and its free end cooperates with the first stationary rotation axis of the support frame.

In summary, therefore, the present invention has created a chair, in particular a desk or office chair, in which the back rest part can be reclined and the seat part can be slid longitudinally and also tilted, and offers the person sitting in it sufficient stability even while executing the corresponding movements of the back rest part and seat part. Naturally, the present invention can also be implemented and used in other forms of seating such as recliners, easy chairs, upholstered furniture, or the like. In all of these designs and applications, however, it is important according to the present invention for the first rotation axis, which is for executing a reclining movement of the back rest part, to be situated in a stationary fashion so that it remains fixed at a predetermined distance above the seat part and for this rotation axis to be situated in the extension of the vertical central axis of the chair structure.

The present invention will be explained in greater detail below in conjunction with the accompanying drawings, using an embodiment form as a non-limiting example. In the preferred embodiment form, reference is made to its use in a desk chair, but the design principle can also be easily applied in the same or a similar manner to all other suitable forms of seating and seating furniture.

Figure 2:
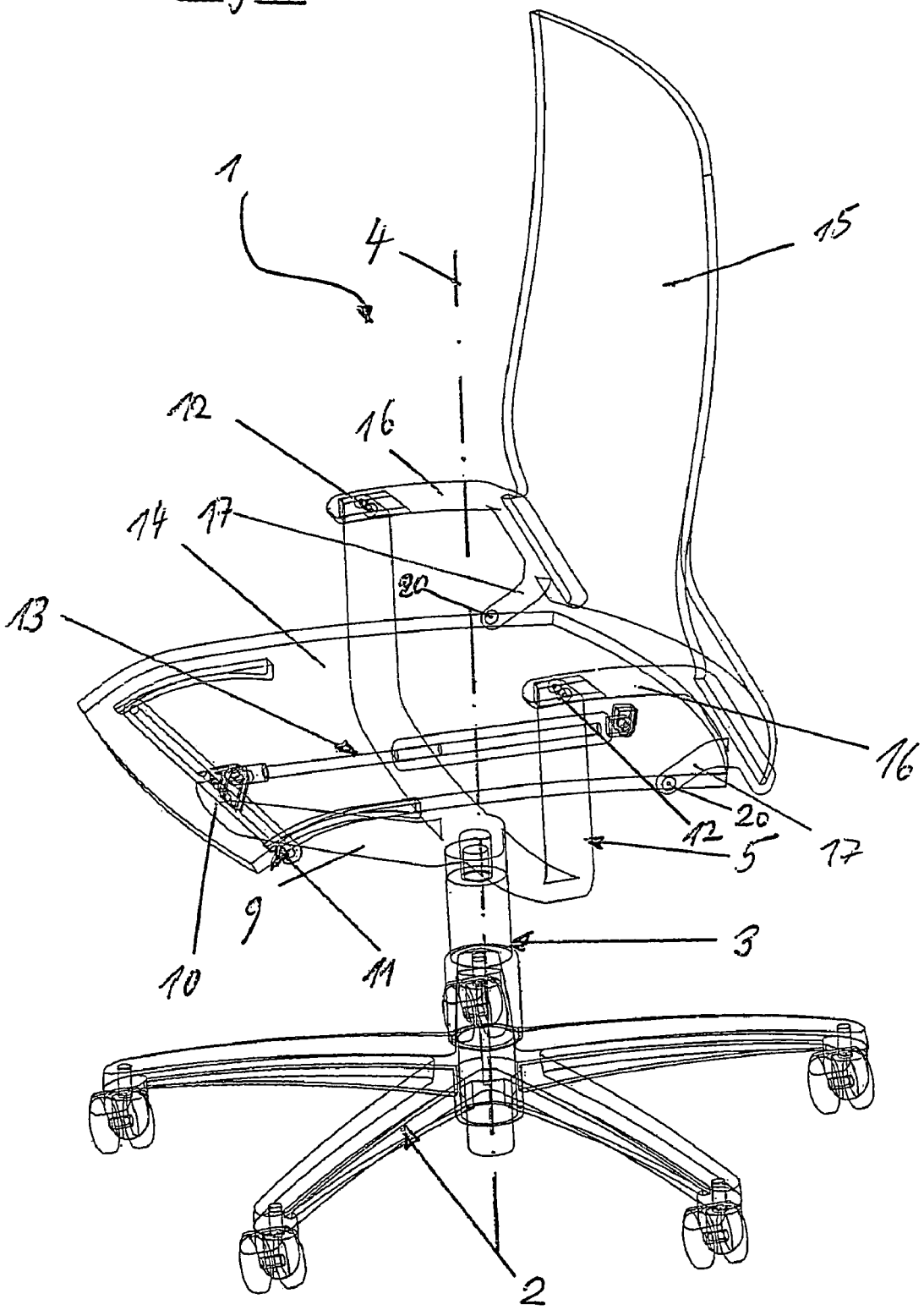
Figure 3:
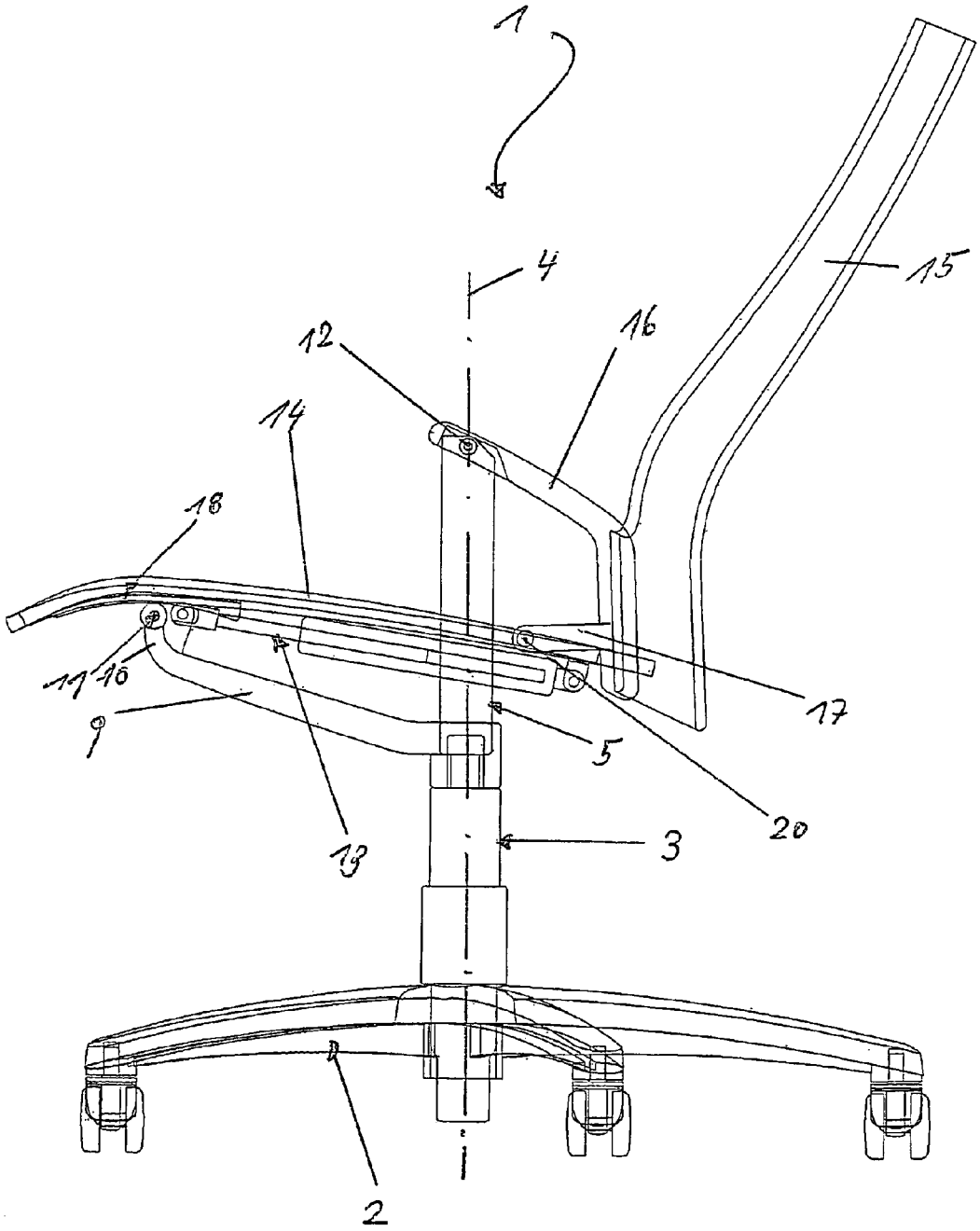
Figure 4:
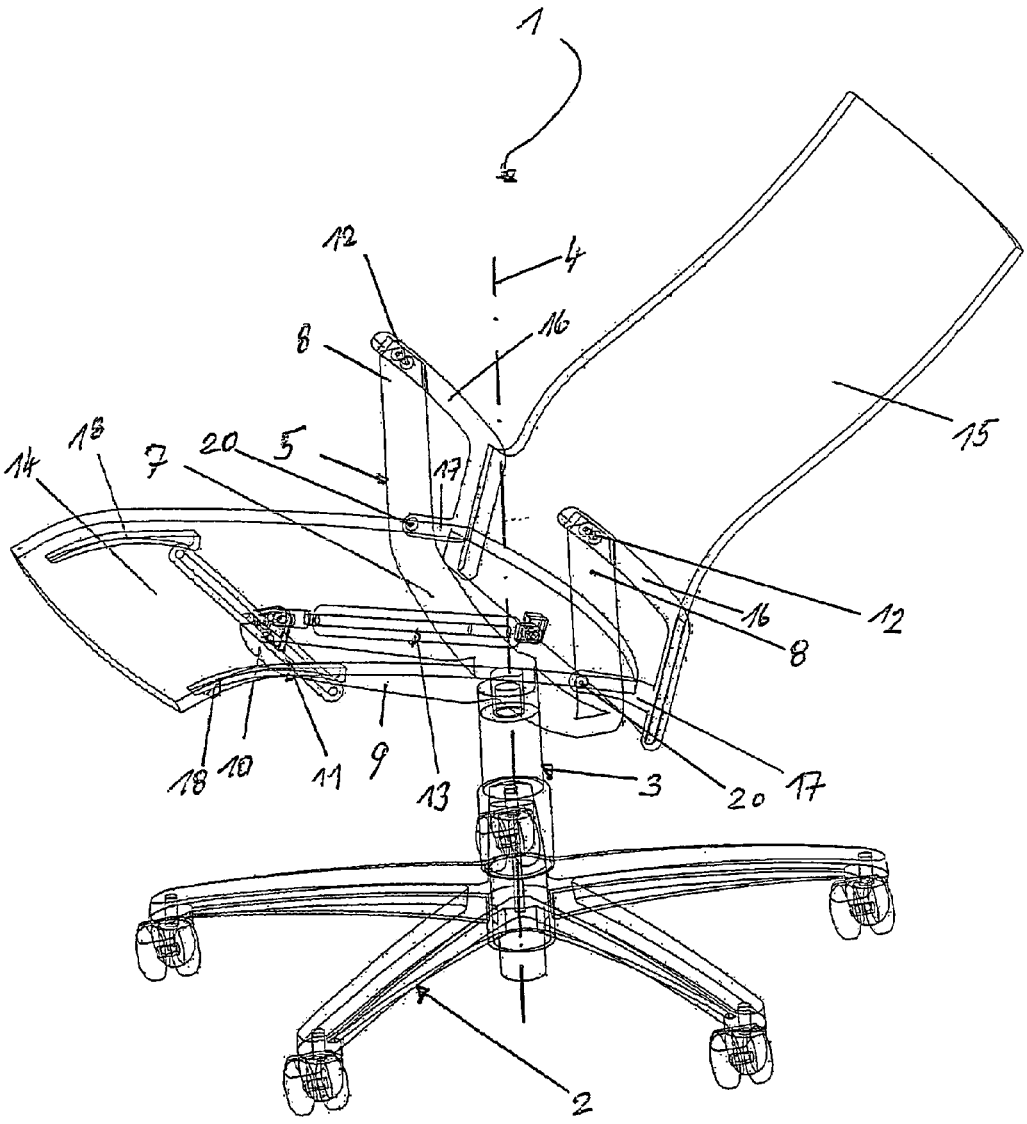

FIG. 1 is a perspective, exploded view of a chair to illustrate its details, FIG. 2 is a perspective, skeletal view of a chair when assembled, with the back rest part in the normal or starting position, FIG. 3 is a schematic side view of the chair from FIG. 2, in a first partially reclined position of the back rest part, and FIG. 4 is a perspective, skeletal view of a chair, in a maximum reclined position of the back rest part.

In the different figures in the drawings, parts that are the same or similar have been provided with the same reference numerals.

The components of the basic structure will be explained in greater detail in conjunction with FIGS. 1 and 2, using an exemplary embodiment in the form of a desk chair labeled as a whole with the reference numeral 1.

As is clear from FIG. 1, a pedestal 2, for example in the form of a central pedestal, is centrally connected by means of a column-shaped part 3, which can, for example, contain a pneumatic spring or the like for height adjustment of the chair, to a support frame 5 that allows the latter to rotate around a central axis 4 over the center of the pedestal. The support frame 5 is comprised of an essentially U-shaped bracket 6, which has a horizontal leg 7 and at the ends of the horizontal leg 7, has upright leg ends 8. Approximately in the middle of the horizontal leg 7 of the support frame 5, a supporting arm 9 is attached to it, which extends approximately perpendicular to the horizontal leg and, at its cantilevered free end 10, supports a third rotation axis 11. The two upright leg ends 8 support a first rotation axis 12 in a stationary fashion. FIGS. 1 and 2 also show a return device 13 embodied, for example, in the form of a spring element, whose one end is attached to the cantilevered free end 10 of the supporting arm 9 and whose other end (see FIG. 2), spaced apart from this in the horizontal direction, is attached to a seat part 14.

The desk chair 1 also has a back rest part, labeled as a whole with the reference numeral 15, which in the example shown, is attached on both sides to a preferably L-shaped pivoting lever 16. In the vicinity of the underside of the back rest part 5, a connecting element 17 is also provided, which is preferably integrally joined to the L-shaped pivoting lever 16 and serves to attach it to the seat part 14. Although the figures in the drawings show a connecting element 17 on both sides of the back rest part 15, it is naturally also possible to provide only one central connecting element 17, situated in the middle and designed to cooperate with the seat part 14 in a correspondingly suitable fashion.

As is clear from the detailed view in FIG. 1, the underside of the seat part 14 has a sliding guide 18 on each side, in the vicinity of the end of the seat part 14 oriented away from the back rest part 15. Although the drawing shows two sliding guides 18, it is naturally also possible to provide only a single sliding guide on the seat part 14, in the form of a centrally located device. In a suitable location, the seat part 14 also has a suitable fastener 19 for one end of the return device 13.

From the skeletal, perspective view of the assembled office chair 1 in FIG. 2, it is clear that in the normal or starting position of the chair 1 depicted, the support frame 5 with the upright leg ends 8, in connection with the L-shaped pivot lever 16, establishes the stationary first rotation axis 12 around which the back rest part 15 can execute a reclining movement. This first rotation axis 12 is situated at a predetermined distance of preferably 50 to 200 mm above the upper edge of the seat part 14, centrally in relation to the pedestal 2. The connecting elements 17 permit the back rest part 15 to move around a second rotation axis 20, which is supported on the seat part 14. The third rotation axis 11, which is provided in a stationary fashion at the cantilevered free end 10 of the supporting arm 9, cooperates with the sliding guides 18 on the underside of the seat part 14. The return device 13, which is attached to the cantilevered free end 10 of the supporting arm 9 at one end and is attached to the seat part 14 at the other, exerts the appropriate forces to execute the returning movements that bring the seat part 14 and the back rest part 15 back into the normal or starting position shown in FIG. 2.

FIG. 3 shows the desk chair 1 in a position with a partially reclined back rest part 15. As is clear from FIG. 3, the first rotation axis 12 is and remains stationary on the support frame 5 and the back rest part 15 executes a reclining motion around this rotation axis 12. With this reclining movement of the back rest part 15, the connecting elements 17, in cooperation with the second rotation axis 20, synchronously force the seat part 14 to move along with this movement, causing it to execute a longitudinal sliding movement and a tilting movement through the cooperation of the third rotation axis 11 and the sliding guide 18 on the seat part 14. The tilting movement of the seat part 14 around the third rotation axis 11 can be predetermined in a suitable fashion through appropriate design of the sliding guide or guides 18 on the seat part 14. In the example shown, thanks to the restrictive guidance of the sliding guides 18 and the third rotation axis 11, the seat part 14 executes a slightly upward tilting movement around the second rotation axis 20, for example synchronously with the longitudinal sliding movement of the seat part 14 in connection with the connecting elements 17 of the back rest part 15 and seat part 14.

FIG. 4 is a skeletal, perspective overview of the desk chair 1 chair in its maximum reclined position of 45° or more in relation to the normal position shown in FIG. 2. Even in this maximum reclined position, the first rotation axis 12 is situated on the support frame 5 in stationary fashion, spaced the same predetermined distance apart from the seat part 14 and also centered in relation to the pedestal so that the center of gravity of the person sitting in the chair always remains largely centered over the support frame 5 in all reclined positions of the back rest part 14. For the connecting elements 17 and the cooperation of the second rotation axis 20, synchronous to the reclining movement of the back rest part 15, the seat part 14 is slid even further in the longitudinal direction and the connecting element 17 assumes an approximately horizontal position or a position in which it lies in the same plane as the seat part 14. This then achieves the end position in terms of the reclined position of the back rest part 15. At the same time, however, the seat part 14 also assumes its greatest possible, preferably upwardly directed tilted position of the seat part 14 through the cooperation of the third rotation axis 11 and the sliding guides 18 on the seat part 14. Naturally, tilted positions of the seat part 14 other than this one can also be executed around the third rotation axis 11, which depends on the corresponding embodiment of the sliding guide or guides 18 provided on the seat part 14.

As is also clear from FIG. 4, the spring element of the return device 13 assumes a maximally stressed position and the two ends of the return device 13 are spaced the smallest distance apart from each other, by contrast with the position of the return device 13 in the normal position of the desk chair 1 shown in FIG. 2. Even in this maximum reclined position of the back rest part 15 of the desk chair 1 shown in FIG. 4, the bodily center of gravity of the person sitting in this desk chair 1 remains essentially centered over the pedestal 2, thus achieving the desired stability and safety, and the support of the back rest part 15 so that it can rotate around the first stationary rotation axis 12 remains at the desired, predetermined distance above the upper edge of the seat part 14 so that even in this maximum reclined position of the back rest part 15, the desk chair 1 as a whole is operationally safe, stable, and steady. As a result, the person sitting in the desk chair 1 according to the present invention assumes a position with a stable center of gravity in every reclined position of the back rest part 15, as well as in every longitudinally slid and tilted position of the seat part 14 so that even in the relaxation position shown in FIG. 4, the person does not feel uneasy.

REFERENCE NUMERAL LIST

1 desk chair as a whole
2 pedestal as a whole
3 column-shaped part
4 central axis
5 support frame
6 bracket
7 horizontal leg
8 leg ends

9 supporting arm
10 cantilevered free end of supporting arm 9
11 third rotation axis
12 first rotation axis
13 return device as a whole
14 seat part
15 back rest part
16 L-shaped pivoting lever
17 connecting element
18 sliding guide
19 fastener for one end of return device 13
20 second rotation axis

What is claimed is:

1. A chair, in particular a desk or office chair, comprising:

a support frame;

a pedestal connected to the support frame;

a back rest part swingably supported to the support frame for rotation around a stationary first rotation axis defined by the support frame for movement of the back rest part from a normal position into a number of reclined positions;

a pivoting lever having one end connected to a lower region of the back rest part for rotation about the first rotation axis;

a seat part connected to the back rest part for rotation with the back rest part around a second rotation axis such that the seat part moves longitudinally in synchronism with the back rest part, when the back rest part moves into an one of the reclined positions, and is forced to rotate around a third rotation axis spaced forwardly from the second rotation axis and defined by contact between the seat part and the support frame; and a return device, secured to the support frame and the seat part, for returning at least one member selected from the group consisting of the back rest part and the seat part to their normal positions, wherein the first rotation axis is positioned in the normal and inclined positions of the member above the seat part at a predetermined distance thereto in midsection of the pedestal.

2. The chair as recited in claim 1, wherein the second rotation axis is level with the seat part.

3. The chair as recited in claim 1, wherein the back rest part is provided with at least one connecting element, which causes the seat part to move in the longitudinal direction relative to the support frame when the back rest part moves to any one of the reclined positions and the connecting element rotates around the second rotation axis.

4. The chair as recited in claim 3, wherein the back rest part is provided with a further said connecting element, said connecting elements respectively attached to both sides of the back rest part.

5. The chair as recited in claim 4, wherein the connecting elements of the back rest part and seat part are connected to the pivoting lever for the back rest part, at its end closer to the back rest part.

6. The chair as recited in claim 1, wherein the third rotation axis is stationary, said seat part having an underside formed with a sliding guide for guiding the third rotation axis during movement of the seat part.

7. The chair as recited in claim 6, wherein the underside of the seat part is formed with a further said sliding guide, said sliding guides respectively attached on both sides of the underside for guiding the third rotation axis.

8. The chair as recited in claim 1, wherein the return device is constituted by a spring device.

9. The chair as recited in claim 1, wherein the support frame is constituted by an essentially U-shaped curved bracket whose horizontal leg extends under the seat part and whose leg ends protrude up above the seat part and support the first rotation axis for the back rest part.

10. The chair as recited in claim 9, wherein the horizontal leg is attached to the pedestal approximately in the middle.

11. The chair as recited in claim 9, wherein the support frame has a supporting arm extending essentially perpendicular to the horizontal leg and supporting the third rotation axis, which cooperates with the seat part for rotation of the seat part.

12. The chair as recited in claim 11, wherein the supporting arm is provided approximately at the middle of the horizontally extending leg of the support frame.

13. The chair as recited in claim 11, wherein the third rotation axis is attached to a free end of the supporting arm.

14. The chair as recited in claim 11, wherein the return device is attached to a free end of the supporting arm and to the seat part.

15. The chair as recited in claim 1, wherein the pedestal is a central pedestal or a tubular frame.

16. The chair as recited in claim 1, wherein the pivoting lever is curved in an L-shape and has another free end which cooperates with the first stationary rotation axis of the support frame.

17. The chair as recited in claim 1, wherein the distance between the first rotation axis and the seat part ranges from 50 to 200 mm.

* * * * *